US011145191B2

(12) United States Patent
De Smet et al.

(10) Patent No.: US 11,145,191 B2
(45) Date of Patent: Oct. 12, 2021

(54) FLASH LIGHT EMITTER WITH REMOTE COMMUNICATION FUNCTION

(71) Applicant: Lumileds LLC, San Jose, CA (US)

(72) Inventors: Thierry De Smet, Aachen (DE); James Tarne, Aachen (DE); Arjen van der Sijde, Aachen (DE); Nicola Bettina Pfeffer, Eindhoven (NL); Olivier Meilhon, Aachen (DE)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 16/467,720

(22) PCT Filed: Nov. 29, 2017

(86) PCT No.: PCT/EP2017/080856
§ 371 (c)(1),
(2) Date: Jun. 7, 2019

(87) PCT Pub. No.: WO2018/104130
PCT Pub. Date: Jun. 14, 2018

(65) Prior Publication Data

US 2020/0066141 A1 Feb. 27, 2020

Related U.S. Application Data

(60) Provisional application No. 62/431,122, filed on Dec. 7, 2016.

(30) Foreign Application Priority Data

Dec. 21, 2016 (EP) ..... 16205856

(51) Int. Cl.
*G08C 23/04* (2006.01)
*F21V 33/00* (2006.01)

(52) U.S. Cl.
CPC ..... *G08C 23/04* (2013.01); *F21V 33/0052* (2013.01); *G08C 2201/93* (2013.01)

(58) Field of Classification Search
CPC . F21V 33/0052; F21V 33/0056; G08C 23/04; G08C 2201/93; H04B 10/1141
See application file for complete search history.

(56) References Cited

U.S. PATENT DOCUMENTS 6,522,437 B2 2/2003 Presley et al.
6,909,849 B1 6/2005 Staley
(Continued)

FOREIGN PATENT DOCUMENTS

CN 1537369 A 10/2004
CN 101123036 A 2/2008
(Continued)

OTHER PUBLICATIONS

"International Application Serial No. PCT/EP2017/080856, International Search Report dated Feb. 26, 2018", 3 pgs.
(Continued)

*Primary Examiner* — Daniell L Negron
(74) *Attorney, Agent, or Firm* — Schwegman Lundberg & Woessner, P.A.

(57) ABSTRACT

A flash light module (1) can include a housing (30) carrying at least a visible flash light emitter (10) to emit a flash light beam along an optical axis (OA) and at least one additional emitter (20) emitting non-visible light arranged at a second distance (D2) perpendicular to the optical axis (OA), where position and orientation of the additional emitter (20) and at least the second distances (D2) are suitably adapted as well as the housing (30) is suitably shaped in order to enable the additional emitter (20) to emit non-visible light (22) along a non-visible light emitting direction (IRD), wherein the additional emitter (20) is adapted to emit the non-visible light
(Continued)

(22) to the environment suitable to remote communicate to, preferably to remote control, external electronic devices (5) comprising corresponding receivers for the non-visible light (22). A mobile device (100) can include the flash light module (1) and a method to operate the mobile device (100).

15 Claims, 4 Drawing Sheets

(56) References Cited

U.S. PATENT DOCUMENTS

| | | | | |
|---|---|---|---|---|
| 7,844,184 | B2 | 11/2010 | Ishihara et al. | |
| 2011/0169727 | A1* | 7/2011 | Akitt | G06F 3/0421 345/156 |
| 2015/0211708 | A1* | 7/2015 | Stavely | F21V 14/06 348/164 |

FOREIGN PATENT DOCUMENTS

| | | | | |
|---|---|---|---|---|
| CN | 101132235 | A | | 2/2008 |
| CN | 102610013 | A | | 7/2012 |
| CN | 202794796 | U | | 3/2013 |
| CN | 205068435 | U | | 3/2016 |
| JP | 10133145 | A | * | 5/1998 |
| TW | M491199 | U | | 12/2014 |
| WO | WO-2018104130 | A1 | | 6/2018 |

OTHER PUBLICATIONS

"International Application Serial No. PCT/EP2017/080856, Written Opinion dated Feb. 26, 2018", 7 pgs.
"Chinese Application Serial No. 201780075842.5, First Office Action dated Jul. 3, 2020", (w/ English Translation), 10 pgs.
"Chinese Application Serial No. 201780075842.5, Notice of Grant dated Jan. 11, 2021", (w/English Translation), 6 pgs.
"Chinese Application Serial No. 201780075842.5, Response filed Sep. 8, 2020 to First Office Action dated Jul. 3, 2020", (w/ English Translation of Claims), 12 pgs.
"European Application Serial No. 16205856.4, extended European Search Report dated Jun. 6, 2017", 7 pgs.
"European Application Serial No. 16205856.4, Observations filed Jul. 6, 2017", 24 pgs.
"European Application Serial No. 17804582.9, Communication Pursuant to Article 94(3) EPC dated Sep. 16, 2020", 5 pgs.
"European Application Serial No. 17804582.9, Office Action dated Sep. 16, 2020", 5 pgs.
"Japanese Application Serial No. 2019-530480, Written Amendment dated Jun. 14, 2019", (w/English Translation of Amendment), 6 pgs.
"Korean Application Serial No. 10-2019-7019579. Request for Examination filed Nov. 30, 2020", (w/English Translation), 11 pgs.
"Taiwanese Application Serial No. 106142410, Office Action dated Aug. 30, 2021", (w/ English Translation), 18 pgs.

* cited by examiner

FLASH LIGHT EMITTER WITH REMOTE COMMUNICATION FUNCTION

PRIORITY APPLICATIONS

This application is a U.S. National Stage Filing under 35 U.S.C. 371 from International Application No. PCT/EP2017/080856, filed on Nov. 29, 2017, and published as WO 2018/104130, which claims priority to European Patent Application No. 16205856.4, filed on Dec. 21, 2016, and U.S. Provisional Patent Application No. 62/431,122, filed on Dec. 7, 2016, all of which are incorporated herein by reference in their entireties.

TECHNICAL FIELD

The disclosed subject matter relates to a flash light module with remote communication function.

BACKGROUND

Electronic devices can be controlled from a remote location via a remote controller. Due to the large number of different electronic devices e.g. in living rooms, a large number of different remote controllers have to be used to control the present devices simultaneously, which could be annoying for users. Remote controllers typically comprise infrared emitter modules to send out infrared signals to the corresponding infrared receivers of the electronic devices to control its operation.

It would be desirable to use at least a reduced number of devices, preferably one device, to control the present electronic devices from a remote location in order to avoid complex learning for each device controller. In order to reduce the number of required remote controllers and to apply easily usable devices, smartphones can be adapted to be used as IR remote controllers. US 2013/0225645 A1 describes a solution where a smartphone is equipped with an additional converter comprising an infrared emitter module as a remote controller connected to the smartphone via an external port, where a remote control application can be installed on the smartphone in order to operate the connected remote controller.

U.S. Pat. No. 6,909,849 B1 discloses a combination of remote control and a flashlight, provided with an infrared light emitting diode and a visible light emitting lightbulb. The infrared light emitting diode and the visible light emitting lightbulb may be positioned in a singular aperture behind a transparent shield.

However, it would be desirable to use a single device for remote communication with other electronic devices without requiring any modification of the single device, e.g. the connection to external adapter modules, in order to make the user handling as easy as possible.

SUMMARY

The system and method can provide a single device for remote communication with other electronic devices without requiring any modification of the single device in order to make the user handling as easy as possible.

According to a first aspect a flash light module is provided. The flash light module comprising a housing carrying at least a visible flash light emitter to emit a flash light beam along an optical axis and at least one additional emitter emitting non-visible light arranged at a second distance perpendicular to the optical axis, where position and orientation of the additional emitter and at least the second distances are suitably adapted as well as the housing is suitably shaped in order to enable the additional emitter to emit non-visible light along an non-visible light emitting direction, wherein the additional emitter is adapted to emit the non-visible light to the environment suitable for inspection purposes or to remote communicate to, preferably to remote control, an external electronic devices comprising corresponding receivers for the non-visible light.

Flash light modules are installed in several different devices such as digital cameras or other mobile devices providing a camera function in addition to other functionalities such as smartphones, tablet PCs, personal digital assistants etc. In some examples, the at least one additional emitter is used in conjunction with a flash as a conventional remote communication module, e.g. as a remote control for the external device or for other communication purposes to transfer data or control signals to the external device. The term "emitted to the environment" denotes the light having passed the flash light lens as last optical element, where the flash light lens might be carried by the device, where the flash light module is installed in, or by the housing itself.

The flash light module may be provided in such a way that the at least one additional emitter is an infrared emitter, the non-visible light is infrared light and the non-visible light emitting direction is an infrared light emitting direction, or the at least one additional emitter is an UV-emitter, the non-visible light is UV-light and the non-visible light emitting direction is a UV-light emitting direction.

The claimed flash light module avoids any duplication of additional emitter systems, e.g. infrared (IR) or ultraviolet (UV) emitter systems, in mobile devices such as smartphones or tablets. The opening in the mobile device used for camera flash is simultaneously reused for the additional emitter for communication purposes, e.g. as a remote control typically using infrared light. The claimed assembly only requires the additional emitter as additional hardware component to provide the remote communication (control) function, while the housing of the flash light module and the optical lens of the flash light module are also used for the emitted non-visible light resulting in ease of assembly and reduction of overall necessary footprint of the dual function solution. Besides communication purposes, the additional non-visible light emitters can be used for inspection purposes such as close distance illumination, e.g. required for a counterfeit detector or to make other UV or IR conversion inks or features visible.

The flash light module might be arranged within a device already carrying a camera and a flash light lens. In this case the flash light module is suitably arranged at a position behind the flash light lens in order to emit the visible light from the flash light emitter as well as the non-visible light from the additional emitter through the flash light lens.

Alternatively the flash light module may be provided in such a way that the flash light module itself comprises the flash light lens being arranged at a first distance in front of the flash light emitter to shape a flash light beam emitted from the visible flash light emitter, where the optical axis is an optical axis of the flash light lens and position and orientation of the flash light lens are also suitably adapted in order to enable the additional emitter to emit the non-visible light through the flash light lens in the non-visible light emitting direction deviating from the optical axis of the flash light lens. The flash light module may be provided in such a way that the first distance is typically 0.3 mm+0.15 mm.

The flash light module may be provided in such a way that the flash light lens has a lateral size sufficient to cover the flash light emitter and the additional emitter when seen in a direction parallel to the optical axis of the flash light lens. A sufficiently large lens enables a flexible positioning of the additional emitter within the flash light modules, where the non-visible light still can be emitted through the flash light lens without any difficulties or additionally required optics to shape the non-visible light beam. In camera flash application the lateral size of the flash light lens is in general a factor of 2 to 3 larger than the flash light emitter, e.g. a LED light source, to allow collimating the camera flash's visible light onto the scene from which the picture shall be taken. The flash light module may be provided in such a way that the flash light lens is a Fresnel lens.

The flash light module may be provided in such a way that the flash light module and at least the additional emitter (and also the flash light lens is case of the flash light module comprising the flash light lens) are suitably arranged in order to emit the non-visible light to the environment (after having passed the flash light lens) under an average emitting angle $\alpha$ between the non-visible light emitting direction and the optical axis of 30°-80°, preferably 50°-70°, more preferably approximately 600. The emitting angle of the non-visible light enables reliably directing the non-visible light to the electronic device in order to communicate to the electronic device from a remote location by the non-visible light beam while simultaneously enabling the control of the device, where the flash light module is installed in. Since the emitted light is not visible, any display solution to control the orientation of the device carrying the flash light module during the communication is not applicable. Thus the user directing the non-visible light beam towards the electronic device has to visibly face the intended direction of the non-visible light and to adjust the orientation of the flash light module accordingly. Therefore the device carrying the flash light module must not block the viewing direction. The specified emitting angles serve this purpose. The average emitting angle is the average angle of the non-visible light, which is emitted to the environment from the flash light lens in a certain emitting cone.

The flash light module may be provided in such a way that the additional emitter is adapted to provide non-visible light of a radiant intensity of at least 10 mW/sr to the environment in non-visible light emitting direction. The additional emitter might be adapted to provide non-visible light with a power of at least 1 mW from the flash light lens in the non-visible light emitting direction. Commonly the non-visible light beam propagates with a certain light cone comprising an interval of different emitting angles and an intensity variation over the emitting angles, where the FWHM intensity is distributed over an interval of emitting angles with a range of 20°. About 1 mW/sr is necessary to communicate with an electronic device at about a distance of 6 m, where a power of 2 mW/sr is preferred. A much larger distance is not desired in order to avoid controlling electronic devices not intended to be controlled, e.g. a neighbor's electronic devices. Non-visible light from emitters arranged outside the optical axis passing through common flash light lenses typically direct 5% of its power to the target region defined by the average emitting angle. The aimed output power of 2 mW at the distance of 6 m can be achieved easily by e.g. so-called 8 mil IR chips delivering 50 mW peak output power in total in remote control protocol pulsed conditions.

The flash light module may be provided in such a way that the second distance is approximately 0.9 mm in order to deliver the required power in the desired direction. In general, the term "approximately" in combination with a certain value shall denote the interval around the given certain value and ±30% to cover also certain adjustment deviations.

The flash light module may be provided in such a way that the flash light emitter comprises a rectangular emitting area, where the second distance denotes the distance to the center of the rectangular emitting area in a x-direction, where the additional emitter is further shifted by a shifting angle $\beta$, preferably not larger than ±20°, e.g. of 18°, with respect to the center of the rectangular emitting area out of the x-direction. The angle $\beta$ will be a best compromise between flash light module design and preferred emitting direction from the mobile device.

The flash light module may be provided in such a way that the flash light emitter comprises an array of LEDs, preferably arranged within a rectangular emitting area in a suitable arrangement. LEDs are small light sources which can be controlled easily. An array of such emitters provides a flash light beam with more intensity and/or broader emission angle The flash light module may be provided in such a way that the flash light module comprises multiple additional emitters arranged around the visible flash light emitter at second distances each, wherein the second distances could be equal or different for different additional emitters. In one embodiment, the second distances of all additional emitters are different. In another embodiment, for some additional emitters of the multiple additional emitters, the second distances are equal, where the other second distances are different. In another embodiment all second distances are equal. All these embodiments allow to hold the device carrying the flash light module in different orientations still enabling communication with the external electronic devices independently from the orientation of the devices carrying the flash light module, because at least one of the multiple additional emitters will emit its non-visible light towards the external electronic device, e.g. to remote control the external device.

The flash light module may be provided in such a way that the housing carrying at least the flash light emitter and the additional emitter is a single piece housing, preferably the housing also carries the flash light lens. Such a flash light module can be distributed and installed in devices carrying the flash light module easily. Therefore the manufacturing process becomes more effective.

The flash light module may be provided in such a way that the housing further comprises electronics allowing fast switching of the flash light emitter and/or the at least one additional emitter. This allows to implement the typical 36 kHz pulsing of the additional IR emitter for remote control, but more generally fast control over the flash light emitter and/or the additional emitter(s) improves the user handling and e.g. allows a simultaneous execution of both functionality applying flash light and communicate with external devices with e.g. the same driver.

The flash light module may be provided in such a way that the housing comprises at least two separate cavities, where the flash light emitter is arranged in a first cavity and the additional emitter is arranged in a second cavity with a separating wall between the first cavity and the second cavity preventing light passing directly from the flash light emitter to the additional emitter and vice versa.

According to a second aspect, a mobile device is provided. The mobile device comprises a flash light module according to the first aspect emitting non-visible light in a non-visible light emission direction in order to enable the mobile device to act as an inspection device or as a remote communication device for external electronic devices comprising corresponding receivers for the non-visible light. The communication may be performed in order to remote control the external device or to transfer data or signals for other purposes to the external device. Besides communication purposes, the additional non-visible light emitters can be used for inspection purposes such as close distance illuminance, e.g. required for a counterfeit detector or to make other UV or IR conversion inks or features visible.

Mobile devices such as smartphones and other portable electronic devices commonly include a camera and a camera flash lighting system. Non-visible lighting systems can be used in conjunction with flash to enable low light focus without irritating pre-flash. The additional emitter associated with the camera flash additionally provides the option that the mobile device is used as a conventional IR remote control in case of emitting infrared light. Any duplication of such emitter systems in mobile devices is avoided. The opening in the mobile device used for camera flash is reused also for the additional emitter resulting in ease of assembly and reduction of overall necessary footprint of the dual function solution.

No additional external devices have to be added to the mobile device in order to provide the remote communication or control function. A single mobile device can be used as a remote communication device for other electronic devices without requiring any modification of the mobile device making the user handling as easy as possible.

The mobile device may be provided in such a way that it is arranged to define a preferred holding orientation with an upper side and a lower side, where a display area is arranged on a front side of the mobile device and the flash light module is arranged on a backside of the mobile device, where the upper side of the mobile device in the preferred holding orientation seen from a holder of the mobile device defines a forward direction, wherein the flash light module is adapted to emit the non-visible light in the forward direction as the non-visible light emission direction.

Since the light emitted from the additional emitter is not visible, any display solution to control the orientation of the device carrying the flash light module is not applicable. Therefore the user directs the non-visible light beam towards the electronic device in the forward direction when visibly targeting the external device across the upper side of the mobile device just as being the case when using conventional dedicated remote control devices. In this case the mobile device and user do not block the viewing direction and reduce the probability to inadvertently block the non-visible beam.

The mobile device may be provided in such a way that an application is installed on the mobile device adapted to control the additional emitter of the flash light module to enable the mobile device acting as a remote communication device, e.g. as a remote control. The control of the flash light module via an executed application is easy and user friendly. The flash light module and the additional emitter are suitably wired to allow control by the application. Therefore the mobile device comprise a processor executing the application and transmitting corresponding control signals to the connected flash light module and the also connected additional emitter in order to emit the required remote communication signals to communicate with the external electronic device.

The mobile device may be provided in such a way that the mobile device is a smartphone, a tablet PC, a personal digital assistant or a digital camera. All these mobile devices comprise a camera function and can be equipped with the flash light module discussed herein.

According to a third aspect, a method to operate a mobile device comprising a flash light module according to the first aspect emitting non-visible light into a non-visible light emission direction to act as a remote communication device for external electronic devices comprising corresponding receivers for the non-visible light is provided. The method comprises the steps of Executing an application installed on the mobile device to control the additional emitter of the flash light module to enable the mobile device acting as a remote communication device;

Holding the mobile device in a preferred holding orientation with an upper side and a lower side, where a display area is arranged on a front side of the mobile device and the flash light module is arranged on a backside of the mobile device, where the upper side of the mobile device in the preferred holding orientation seen from a holder of the mobile device defines a forward direction, wherein the flash light module is adapted to emit the non-visible light into the forward direction as an non-visible light emission direction;

Directing the mobile device in the forward direction towards one of the external electronic devices; and Communicating with the external electronic device from a remote location via the application and the non-visible light emitted from the additional emitter.

The remote communication may be executed in order to remote control the external electronic devices

BRIEF DESCRIPTION OF THE DRAWINGS

In the drawings.

In the Figures, like numbers refer to like objects throughout. Objects in the Figs. are not necessarily drawn to scale.

DETAILED DESCRIPTION OF EMBODIMENTS

Various embodiments will now be described by means of the Figures.

Figure 1:
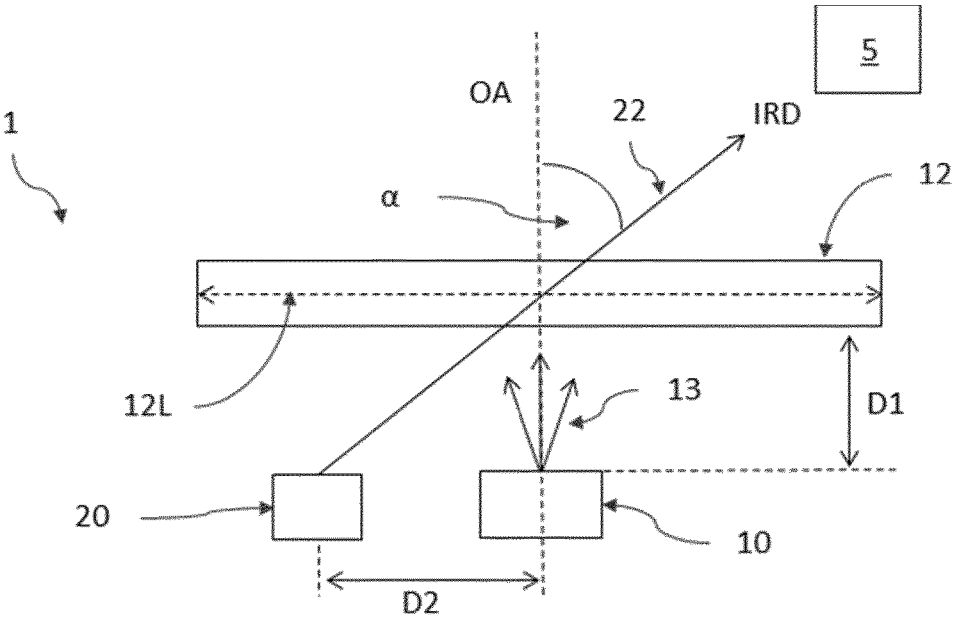
FIG. 1 shows a principle sketch of the main components of an example of the flash light module according to some embodiments in a side view.

FIG. 1 shows a principle sketch of the main components of an embodiment of the flash light module 1 in a side view. The flash light module 1 comprises a visible flash light emitter 10 arranged at a first distance D1 to a flash light lens 12 in front of the flash light emitter 10, where the flash light lens 12 shapes a flash light beam 13 emitted from the visible flash light emitter 10. The flash light lens 12 might be Fresnel lens. The flash light lens 12 might be part of the flash light module 1 or might be a separate component of any device carrying the flash light module 1. This arrangement corresponds to typical flash light module.

The flash light module 1 further comprises an additional emitter 20, here an infrared emitter 20, arranged at a second distance D2 perpendicular to an optical axis OA of the flash light lens 12, where position and orientation of the infrared emitter 20 and the first and second distances D1, D2 are suitable adapted. Here the first distance D1 is approximately 0.3 mm and the second distance D2 is approximately 0.9 mm. In this embodiment the flash light lens 12 has a lateral size 12L sufficient to cover the flash light emitter 10 and the infrared emitter 20 when seen in a direction parallel to the optical axis OA of the flash light lens 12. The optical axis OA is perpendicular to the outer surface of the flash light lens 12 and passes the center of the flash light lens 12.

Furthermore a housing 30 (not shown here, see FIG. 2) carrying at least the flash light emitter 10 the flash light lens 12 and the infrared emitter 20 is suitably shaped in order to enable the infrared emitter 20 to emit infrared light 22 through the flash light lens 12 in an infrared light emitting direction IRD deviating from the optical axis OA of the flash light lens 12, wherein the infrared emitter 20 is adapted to emit the infrared light 22 suitable to remote control external electronic device 5 comprising a corresponding infrared receiver. Here the infrared light 22 is emitted from the flash light lens 12 under an emitting angle α between the infrared light emitting direction IRD and the optical axis OA of −30° to 80°, preferably 50°-70°, more preferably approximately 600.

In other embodiments not shown here the additional emitter 20 emits the non-visible light 22 as infrared light or UV-light to the environment for inspection purposes, e.g. as close distance illumination required for a counterfeit detector or to make other UV or IR conversion inks or features visible.

Figure 2:
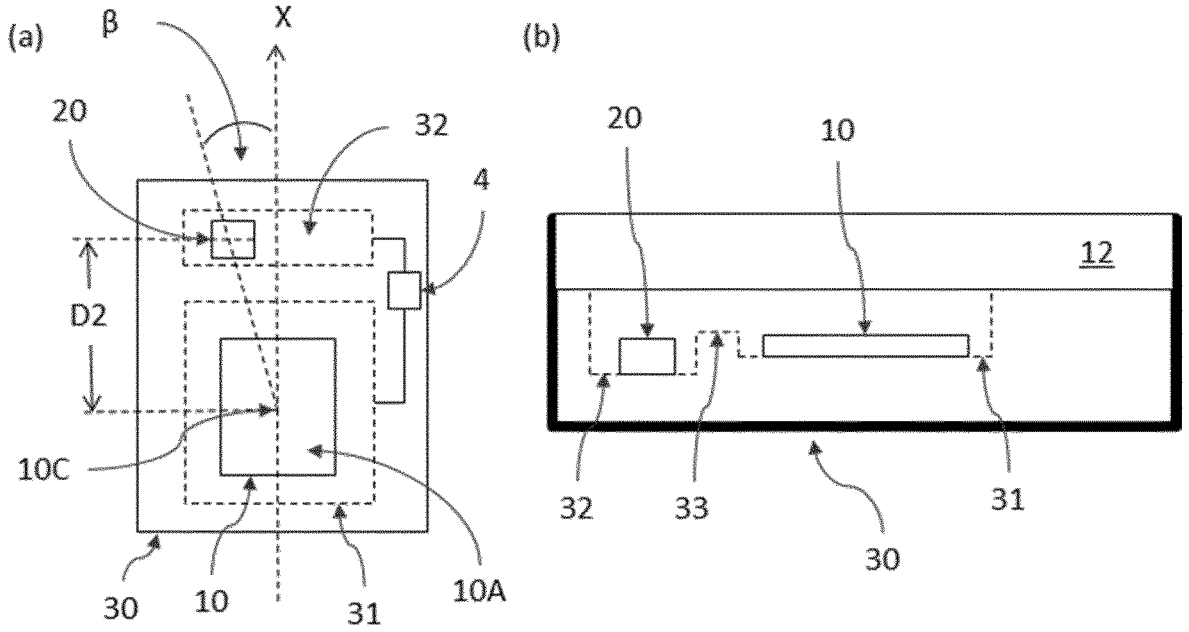
FIG. 2 shows a principle sketch of an example of the flash light module according to some embodiments in (a) a top view, and (b) a side view.

FIG. 2 shows a principle sketch of an embodiment of the flash light module in (a) a top view, and (b) a side view as a vertical cut of FIG. 2*a* along the indicated x-direction. In this embodiment the flash light module 1 comprises a housing 30 which carries the flash light emitter 10, the flash light lens 12 and the infrared emitter 20. In this embodiment the housing is a single piece housing 30, where the components are added to. The housing 30 comprises two separate cavities 31, 32, where the flash light emitter 10 is arranged in a first cavity 31 and the infrared emitter 20 is arranged in a second cavity 32 with a separating wall 33 between the first cavity 31 and the second cavity 32 preventing light passing directly from the flash light emitter 10 to the infrared emitter 20 and vice versa. Here, the cavities 31, 32 have different depths, where the second cavity 32 has a larger depth in order to hold the infrared emitter 20 having a larger height compared to the flash light emitter 10. In other embodiments the depths of the cavities might be equal or inverted to optimize the preferred exit angle of the infrared light from the infrared emitter 20 and/or from the flash light lens 12. The cavities here are differently shaped, where the first cavity 31 has a larger lateral size as the second cavity 32 adapted to the size of the emitter 10, 20 arranged at the bottom of each of the cavities 31, 32. In other embodiments the cavities 31, 32 may have equal lateral sizes. The electronic connection between each emitter and their corresponding driver are not shown here in detail. People skilled in the art are able to provide suitable connections through the housing to connect the emitters 10, 20.

In this embodiment the flash light emitter 10 comprises a rectangular emitting area 10A, where the second distance D2 denotes the distance to the center 10C of the rectangular emitting area 10A in a x-direction, where the infrared emitter 20 is further shifted by a shifting angle β, in this case 18°, with respect to the center 10C of the rectangular emitting area 10A out of the x-direction. The flash light emitter 10 may comprise an array of LEDs as the rectangular emitting area 10A. In this embodiment the flash light module 1 further comprises an electronics 4 connected to the emitters 10, 20 (indicated by the dashed lines) allowing fast switching of the flash light emitter and/or the at least one additional emitter 20.

Figure 3:
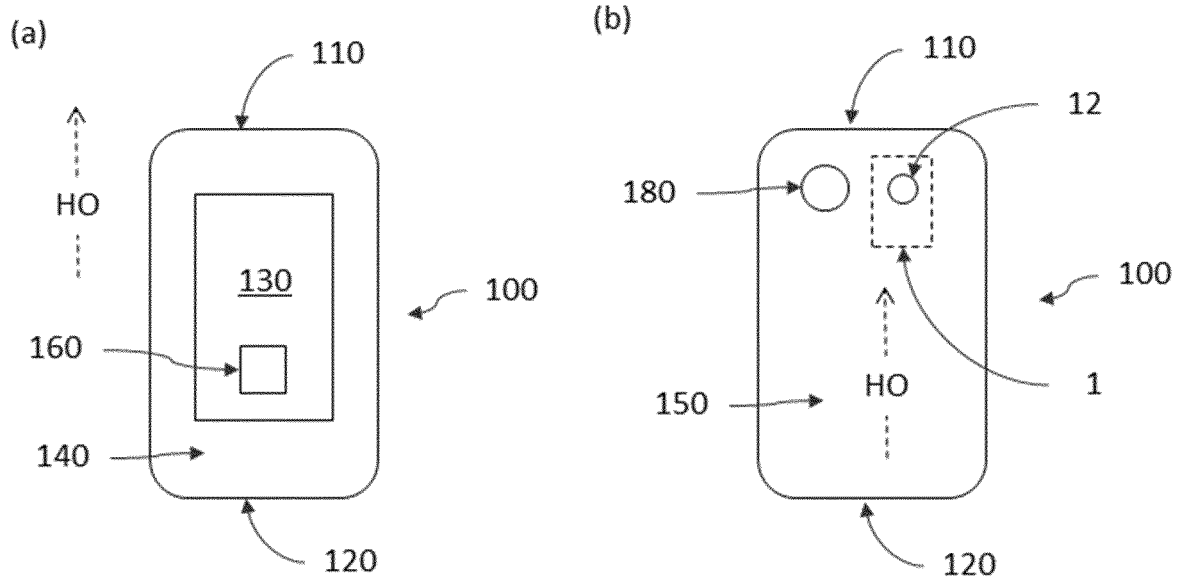
FIG. 3 shows a principle sketch of an example of the mobile device according to some embodiments in (a) a top view, and (b) a view on its backside.

FIG. 3 shows a principle sketch of an embodiment of the mobile device 100 in (a) a top view, and (b) a view on its backside. The mobile device 100 comprises a flash light module 1 according to the first aspect (dashed area in FIG. 3*b*) emitting non-visible light 22 (e.g. infrared light or UV-light) into a non-visible light emission direction IRD in order to enable the mobile device 100 to e.g. act as a inspection device or as a remote control device for the external electronic device 5 comprising a corresponding receiver for the non-visible light. The flash light module 1 is arranged beside the camera 180. The mobile device comprises an upper side 110 and a lower side 120 as well as a front side 140 and a backside 150 opposite the front side. The front side view is shown in FIG. 3*a* where a display area 130 is arranged on a front side 140 of the mobile device 100. An application 160 indicated by the solid square is installed on the mobile device 100 and is adapted to control the additional emitter 20 of the flash light module 1 to enable the mobile device 100 acting as a remote control.

The backside view is shown in FIG. 3*b*, where the flash light module 1 is arranged on a backside 150 of the mobile device 100. A preferred holding orientation HO seen from a holder 170 of the mobile device 100 is indicated by the dashed arrow, where the upper side 110 is the upper end and the lower side 120 is the lower end of the mobile device.

The mobile device 100 shown in FIGS. 3*a* and 3*b* might be a smartphone or a tablet PC or a personal digital assistant or a digital camera.

Figure 4:
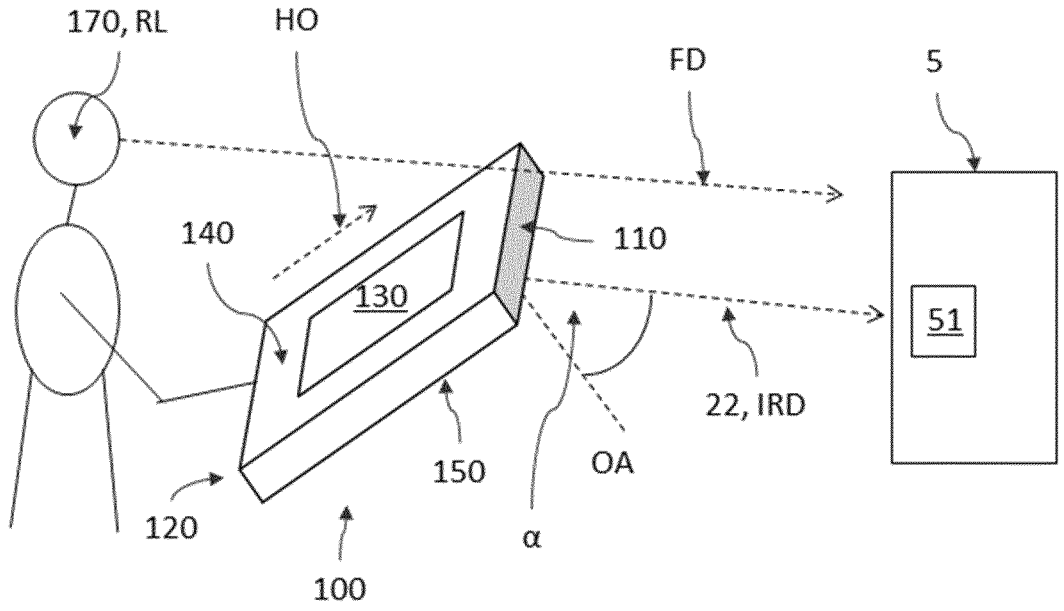
FIG. 4 shows a principle sketch of other examples of the mobile device according to some embodiments acting as a remote control.

FIG. 4 shows a principle sketch of other embodiments of the mobile device 100 acting as a remote control emitting infrared light. Here the mobile device 100 is arranged in the preferred holding orientation HO (indicated by the dashed arrow) with the upper side 110 upside and the lower side 120 downside. The upper side 120 in the preferred holding orientation HO seen from the holder 170 of the mobile device 100 at a remote location RL defines a forward direction FD when further extrapolating the line of view (see dashed line FD). In this position the infrared light 22 is emitted in the forward direction FD as the infrared light emission direction IRD towards the external electronic device 5 comprising a corresponding infrared receiver 51 to receive the infrared light 22 emitted from the flash light module 1 of the mobile device 100. Here, the flash light lens 12 and the additional emitter 20 are adapted to provide an infrared power of about 20 mW/sr from the flash light lens 12 in infrared light emitting direction IRD. When executing the application 160 installed on the mobile device 100 to control the infrared emitter 20 of the flash light module 1 and directing the mobile device 100 in the forward direction FD towards the external electronic devices 5, which can be controlled from the remote location RL by the holder 170.

Figure 5:
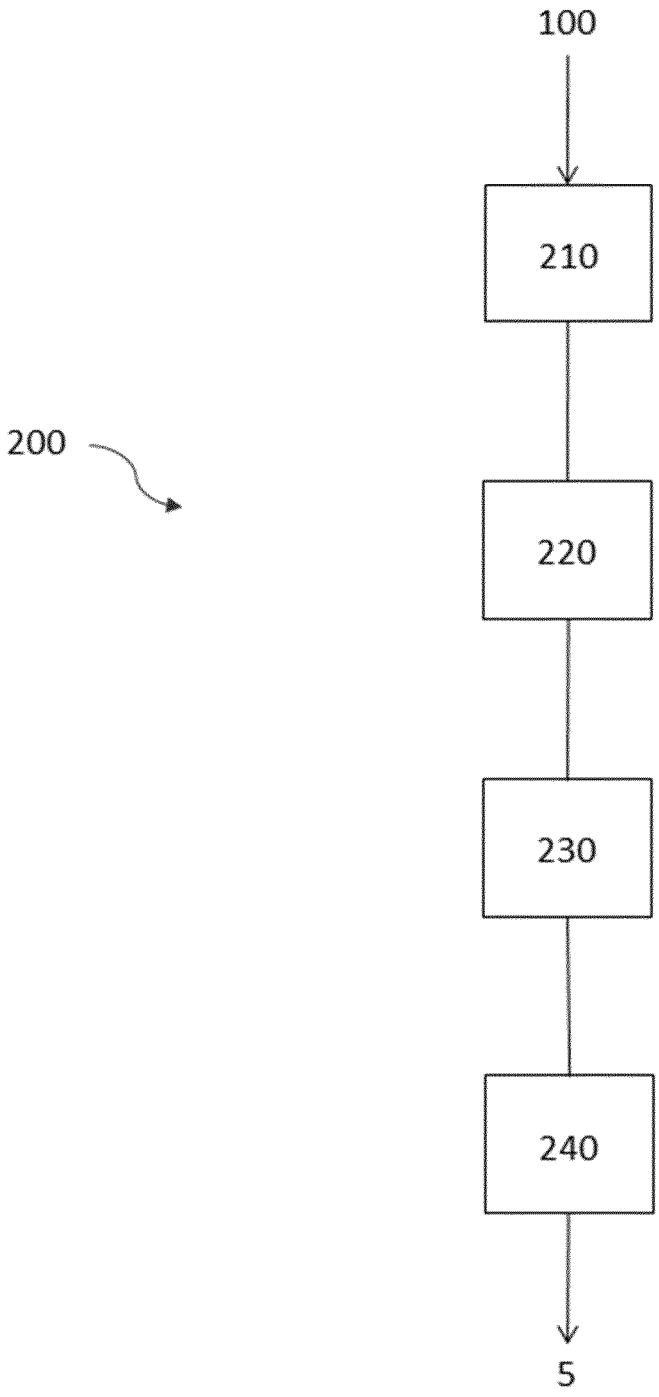
FIG. 5 shows a principle sketch of an example of the method for operating the mobile device according to some embodiments.

FIG. 5 shows a principle sketch of an embodiment of the method 200 for operating the mobile device 100 comprising a flash light module 1 emitting non-visible light 22 into a non-visible light emission direction IRD to act as a remote communication device for the external electronic device 5 comprising a corresponding receiver for the non-visible light 22.

The method 200 comprises the steps of executing 210 an application 160 installed on the mobile device 100 to control the additional emitter 20 of the flash light module 1 to enable the mobile device 100 acting as a remote communication device; holding 220 the mobile device 100 in a preferred holding orientation HO with an upper side 110 and a lower side 120, where a display area 130 is arranged on a front side 140 of the mobile device 100 and the flash light module 1 is arranged on a backside 150 of the mobile device 100, where the upper side 110 of the mobile device 100 in the preferred holding orientation HO seen from a holder 170 of the mobile device 100 defines a forward direction FD, wherein the flash light module 1 is adapted to emit the non-visible light 22 into the forward direction FD as a non-visible light emission direction IRD; directing 230 the mobile device 100 with the forward direction FD towards one of the external electronic devices 5; and communication 240 with the external electronic device 5 from a remote location RL via the application 160 and the non-visible light 22 emitted from the additional emitter 20.

Figure 6:
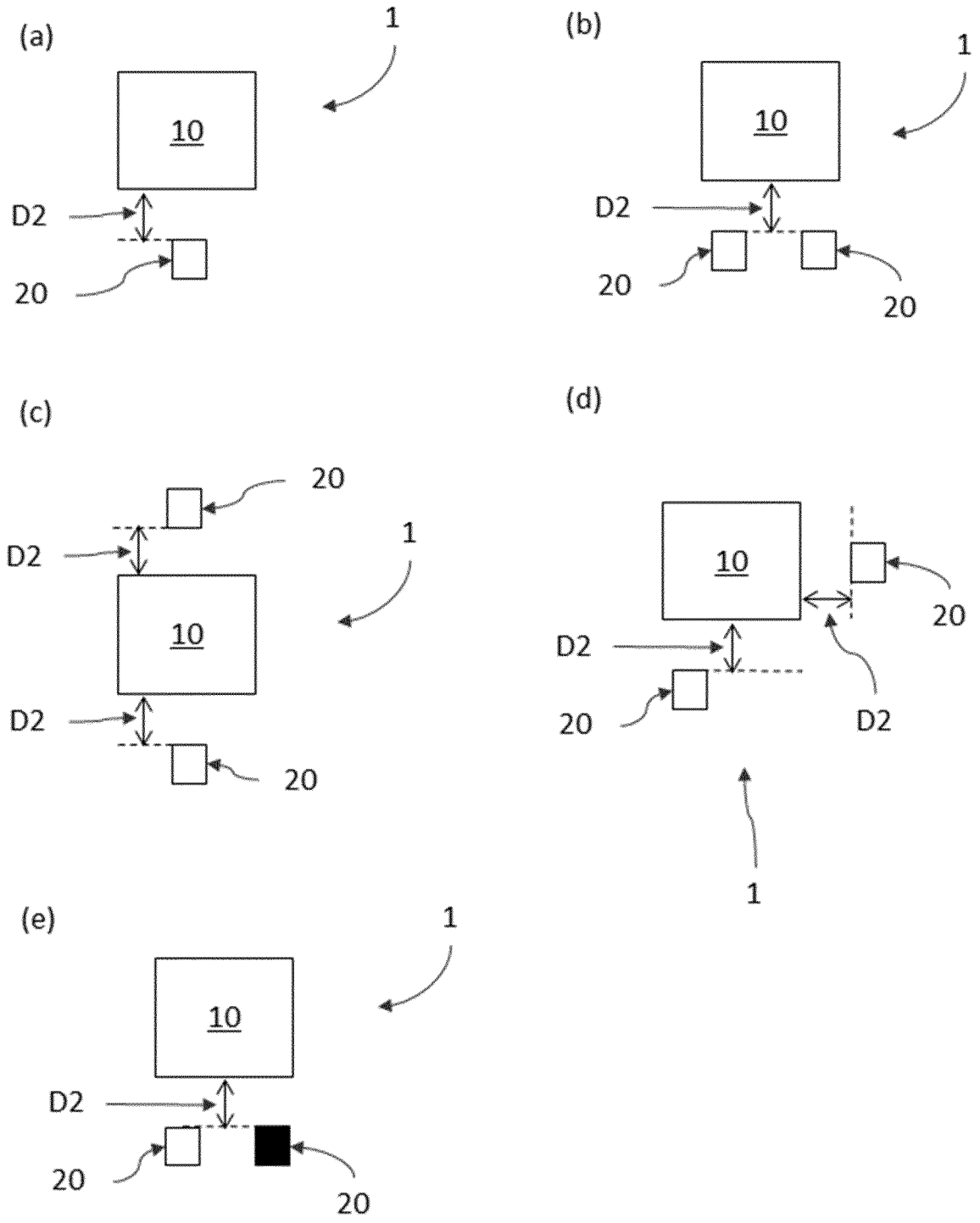
FIG. 6 shows a principle sketch of different examples (a)-(e) of arrangements of flash light and additional emitters in the flash light module according to some embodiments.

FIG. 6 shows a principle sketch of different embodiments (a)-(e) arrangements of flash light and additional emitters 10, 20 in the flash light module 1. In embodiment (a) the flash light module 1 comprises beside a flash light emitter 10 (eventually comprising an array of light sources, e.g. LEDs) only one additional emitter 20 arranged at a second distance D2 to the flash light emitter 10. In embodiment (b) the flash light module 1 comprises beside a flash light emitter 10 (eventually comprising an array of light sources, e.g. LEDs) two additional emitters 20 both arranged at a second distance D2 to the flash light emitter 10 in the area near the corners of the flash light emitter. In embodiment (c) the flash light module 1 comprises beside a flash light emitter 10 (eventually comprising an array of light sources, e.g. LEDs) two additional emitters 10 arranged on opposite sides of the flash light emitter 10 each at a second distance D2 to the flash light emitter 10. In embodiment (d) the flash light module 1 comprises beside a flash light emitter 10 (eventually comprising an array of light sources, e.g. LEDs) two additional emitters 10 arranged at neighbored sides of the flash light emitter 10 each at a second distance D2 to the flash light emitter 10. In embodiment (e) the flash light module 1 comprises beside a flash light emitter 10 (eventually comprising an array of light sources, e.g. LEDs) two additional emitters 20 both arranged at a second distance D2 to the flash light emitter 10 in the area near the corners of the flash light emitter, where one of the additional emitters 20 (e.g. the non-filled square 20 on the left) is an infrared emitter 20 and the other additional emitter 20 (e.g. the solid square 20 on the right) is an UV-light emitter 20. In other embodiments not shown here, there might be more than two additional emitters 20 arranged inside the flash light module 1, e.g. in equal distances around the flash light emitter 10 with one two or more additional emitters 20 at each side of the flash light emitter 10. These additional emitters may emit non-visible light within the same or different non-visible ranges of the emission spectrum. In FIG. 6 the second distances D2 of different additional emitters 20 are shown as being equal. In other embodiments (not shown here) the second distances D2 might be different for different additional emitters 20.

While various examples have been illustrated and described in detail in the drawings and the foregoing description, such illustration and description are to be considered illustrative or exemplary and not restrictive.

From reading the present disclosure, other modifications will be apparent to persons skilled in the art. Such modifications may involve other features which are already known in the art and which may be used instead of or in addition to features already described herein.

Variations to the disclosed embodiments can be understood and effected by those skilled in the art, from a study of the drawings, the disclosure and the appended claims. In the claims, the word "comprising" does not exclude other elements or steps, and the indefinite article "a" or "an" does not exclude a plurality of elements or steps. The mere fact that certain measures are recited in mutually different dependent claims does not indicate that a combination of these measures cannot be used to advantage.

Any reference signs in the claims should not be construed as limiting the scope thereof.

LIST OF REFERENCE NUMERALS

1 flash light module
10 flash light emitter
10A emitting area of the flash light emitter
10C center of the emitting area of the flash light emitter
12 flash light lens
12L lateral size of the flash light lens
13 flash light beam
20 additional emitter
22 non-visible light (e.g. infrared or UV)
30 housing
31 first cavity of the housing
32 second cavity of the housing
33 separating wall between first and second cavity
4 electronics to allow fast switching of emitters 10, 20
5 external electronic devices
51 receiver of the external device for the non-visible light
100 mobile device, e.g. a smartphone or a tablet PC
110 upper side of the mobile device
120 lower side of the mobile device
130 display area of the mobile device
140 front side of the mobile device
150 backside of the mobile device
160 application installed and executed on the mobile device
170 holder of the mobile device
180 camera of the mobile device
200 method to operate a mobile device as a remote communication device for external electronic devices
210 executing an application installed on the mobile device to control the additional emitter
220 holding the mobile device in a preferred holding orientation
230 directing the mobile device with the forward direction towards one of the external electronic devices
240 communicating with the external electronic device from a remote location via the application
α emitting angle between non-visible light emitting direction and optical axis
β shifting angle of the position of the additional emitter
D1 distance between visible flash light emitter and flash light lens
D2 distance between optical axis of the flash light lens and the additional emitter
FD forward direction of the mobile device in preferred holding orientation
IRD non-visible light emitting direction
HO preferred holding orientation of the mobile device
OA optical axis of the flash light lens
RL remote location
x x-direction

The invention claimed is:

1. A system, comprising:

a single-piece housing including a first cavity, a second cavity, and a separating wall positioned between the first cavity and the second cavity;

a visible light emitter positioned in the first cavity and configured to emit a visible light beam along an optical axis;

a non-visible light emitter positioned in the second cavity and positioned away from the optical axis, the non-visible light emitter configured to emit a non-visible light beam that is angled with respect to the optical axis, the separating wall being configured to prevent visible light from passing directly from the visible light emitter to the non-visible light emitter and prevent non-visible light from passing directly from the non-visible light emitter to the visible light emitter; and a lens disposed in or on the housing, the lens configured to shape the visible light beam and pass the non-visible light beam through the lens such that the passed non-visible light beam is angled with respect to the optical axis.

2. The system of claim 1, wherein the non-visible light emitter includes at least one of an infrared emitter configured to emit infrared light or an ultraviolet emitter configured to emit ultraviolet light.

3. The system of claim 1, wherein the lens is spaced apart from the visible light emitter by a spacing between about 0.15 millimeters and about 0.45 millimeters.

4. The system of claim 1, wherein the non-visible light beam is angled with respect to the optical axis by an angle between about 30 degrees and about 80 degrees.

5. The system of claim 1, wherein the non-visible light emitter is further configured such that the non-visible light beam has a radiant intensity of at least 10 milliwatts per steradian.

6. The system of claim 1, wherein the non-visible light emitter is spaced apart from the optical axis by approximately 0.9 millimeters.

7. The system of claim 1, further comprising at least one additional non-visible light emitter positioned around the visible light emitter and configured to emit non-visible light through the lens.

8. The system of claim 1, further comprising electronics positioned in or on the single piece housing, the electronics configured to switch at least one of the visible light emitter or the non-visible light emitter.

9. The system of claim 1, further comprising a mobile device disposed in or on the housing.

10. The system of claim 9, wherein the mobile device includes an application to control the non-visible light emitter such that the mobile device is configured to function as a remote communication device.

11. The system of claim 9, wherein the mobile device includes at least one type of a mobile device selected from a smartphone, a tablet PC, a personal digital assistant, and a digital camera.

12. A method, comprising:

emitting, with a visible light emitter positioned in a first cavity of a single-piece housing, a visible light beam along an optical axis, the single-piece housing including the first cavity, a second cavity, and a separating wall positioned between the first cavity and the second cavity;

emitting, with a non-visible light emitter positioned in the first cavity and positioned away from the optical axis, a non-visible light beam that is angled with respect to the optical axis;

preventing, with the separating wall, visible light from passing directly from the visible light emitter to the non-visible light emitter;

preventing, with the separating wall, non-visible light from passing directly from the non-visible light emitter to the visible light emitter;

shaping, with a lens disposed in or on the housing, the visible light beam; and passing, with the lens, the non-visible light beam through the lens such that the passed non-visible light beam is angled with respect to the optical axis.

13. The method of claim 12, wherein the non-visible light emitter includes at least one of an infrared emitter configured to emit infrared light or an ultraviolet emitter configured to emit ultraviolet light.

14. The method of claim 12, further comprising:

emitting, with at least one additional non-visible light emitter positioned around the visible light emitter, non-visible light through the lens.

15. The method of claim 12, further comprising:

switching, with electronics positioned in or on the single piece housing, at least one of the visible light emitter or the non-visible light emitter.

* * * * *